United States Patent [19]

Stroup

[11] Patent Number: 4,939,977

[45] Date of Patent: Jul. 10, 1990

[54] GUN SILENCER AND MUZZLE PROTECTOR

[76] Inventor: Larry J. Stroup, P.O. Box 743, Oswego, Ill. 60543-0743

[21] Appl. No.: 362,602

[22] Filed: Jun. 7, 1989

[51] Int. Cl.[5] ..... F41A 21/30

[52] U.S. Cl. ..... 89/14.4

[58] Field of Search ..... 89/1.2, 14.2, 14.3, 89/14.4

[56] References Cited

U.S. PATENT DOCUMENTS 832,695 10/1906 Nygaard .
1,130,609 3/1915 Jones .

FOREIGN PATENT DOCUMENTS 1021270 2/1953 France ..... 89/14.4
106851 6/1917 United Kingdom ..... 89/14.4

*Primary Examiner*—Charles T. Jordan
*Assistant Examiner*—Richard W. Wendtland
*Attorney, Agent, or Firm*—Fleit, Jacobson, Cohn, Price, Holman & Stern

[57] ABSTRACT

A gun silencer and muzzle protector utilizes a hollow housing mounted on a gun barrel with expandable release doors being positioned within the housing. The release doors are pivotally mounted within the housing and are normally retained together in a cone-shaped abutting relationship through the use of a circumferentially extending spring positioned about the doors. A lining employed in the housing silences a gunshot and several different types of adapters may be utilized to mount the housing and associated doors to the gun barrel. The adapters include a first type which is threadably attachable to a gun barrel, a second type which utilizes a split sleeve construction to clamp the adapter to a gun barrel, and a third type which utilizes a radially extending clamp member to clamp the adapter to the gun barrel with the third type of adapter being used in conjunction with any type and caliber of gun. Additionally, caliber change inserts may be utilized in conjunction with the silencer to permit the use of the same silencer on various caliber guns.

4 Claims, 4 Drawing Sheets

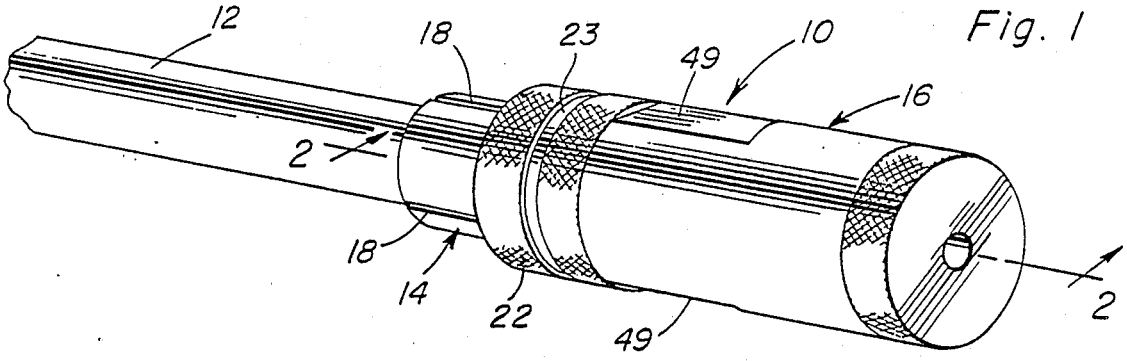
Fig. 1
Fig. 2
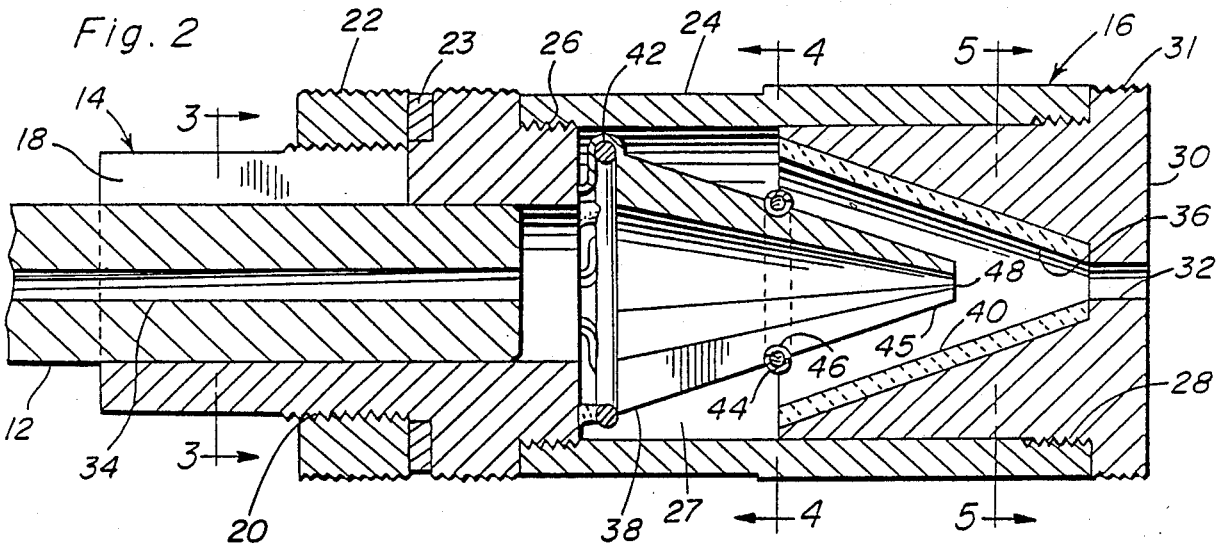
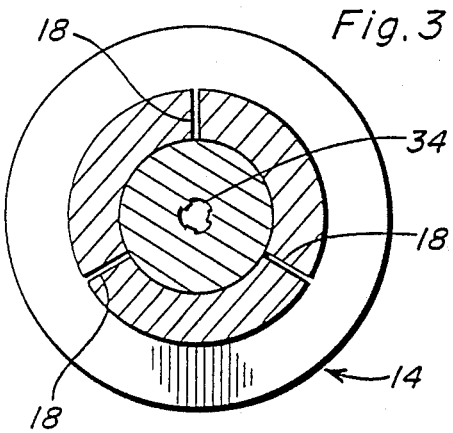
Fig. 3
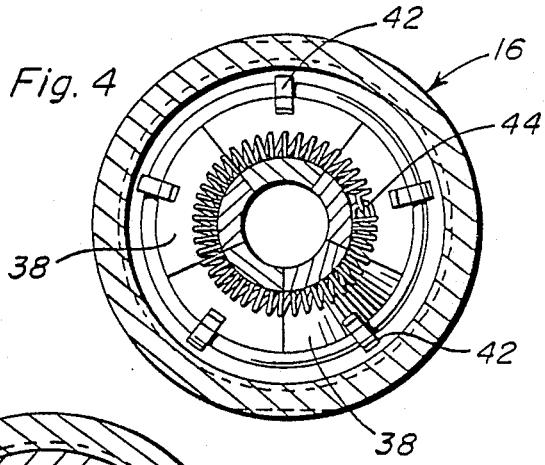
Fig. 4
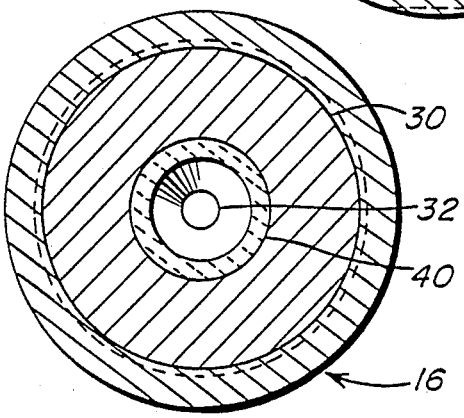
Fig. 5

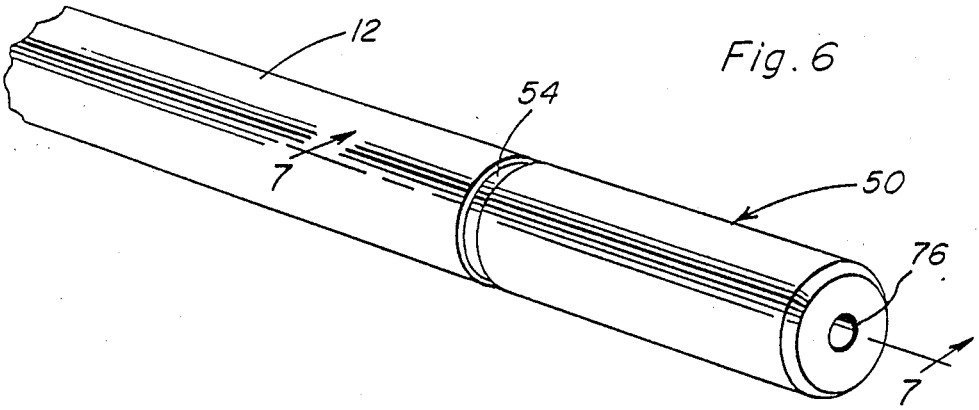
Fig. 6
Fig. 7
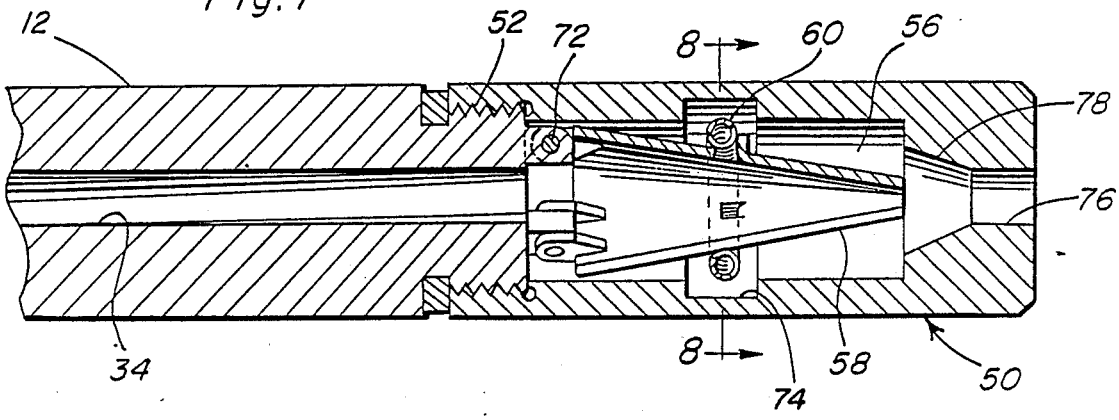
Fig. 8
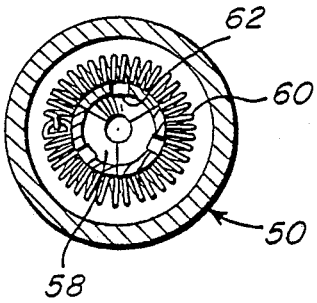
Fig. 9
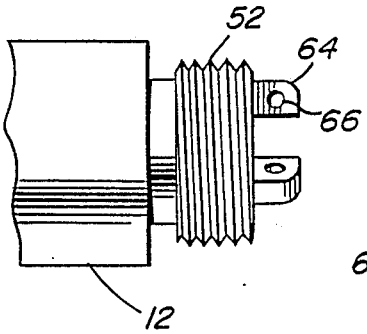
Fig. 10
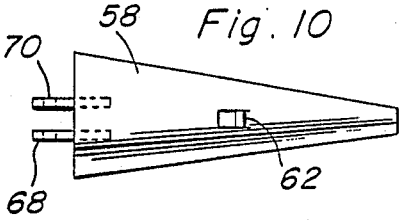
Fig. 11
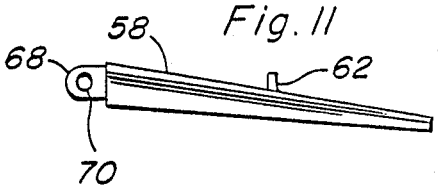
Fig. 12
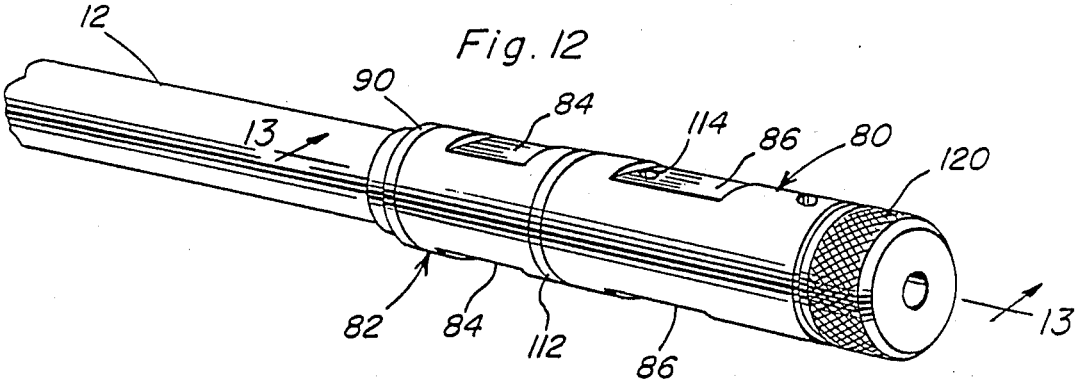

GUN SILENCER AND MUZZLE PROTECTOR

BACKGROUND OF THE INVENTION

Field of the Invention

The present invention generally relates to noise suppressing devices and more particularly pertains to a new and improved gun silencer and muzzle protector.

INFORMATION DISCLOSURE STATEMENT

Gun silencers threadably or otherwise secured to the end of a gun to effect a silencing thereof are well known but most of these prior art silencers are quite bulky in size and inefficient in operation. The prior art devices are not the same as or equivalent to the gun silencer and muzzle protector of this invention.

SUMMARY OF THE INVENTION

An object of the present invention is to provide several embodiments of adapters for attaching the silencer to a gun barrel, as well as specifically designed silencers which effectively reduces the noise of a gunshot and protects the muzzle of the gun barrel and which includes a silencing chamber provided inside a housing through which a bullet must pass. A plurality of expandable release doors are provided within the chamber to effectively reduce the noise associated therewith. The release doors, which may be of a cast or molded construction, are pivotally retained in a cone-shaped abutting relationship through the use of a circumferentially extending spring, and an exiting bullet, along with the attendant gas pressure, will force the doors open at an apex portion thereof to permit the bullet to pass outwardly from the silencing chamber.

Another object of the invention is to provide several different types of mounting adapters, one such adapter having longitudinal slots, which enable the adapter to be clamped on the barrel. A second type of adapter has the silencer threadably attached thereto and is attachable to the end of a gun barrel by means of a radially movable clamp member to secure the adapter to the barrel. A third adapter employs the use of threads integrally formed on the end of the gun barrel which enable the silencer to be threadably attached directly thereto.

A further object of this invention is the provision of various constructions of release doors, as well as caliber change inserts which may be selectively positioned within a silencing chamber so as to vary the caliber of a particular silencer, thus facilitating its use on different caliber guns.

These, together with other objects and advantages which will be come subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a first embodiment of the gun silencer and muzzle protector of the present invention.

FIG. 2 is a longitudinal sectional view of the invention taken along the line 2—2 on FIG. 1.

FIG. 3 is a transverse sectional view taken along the line 3—3 on FIG. 2.

FIG. 4 is a transverse sectional view taken along the line 4—4 on FIG. 2.

FIG. 5 is a transverse sectional view taken along the line 5—5 on FIG. 2.

FIG. 6 is a perspective view of a second embodiment of the invention.

FIG. 7 is a longitudinal sectional view taken along the line 7—7 on FIG. 6.

FIG. 8 is a transverse sectional view taken along the line 8—8 on FIG. 7.

FIG. 9 is a detailed view of the mounting adapter utilized in the embodiment of FIG. 7.

FIG. 10 is a top plan view of an expandable release door utilized in the embodiment of FIG. 7.

FIG. 11 is a side elevation view of the expandable release door shown in FIG. 10.

FIG. 12 is a perspective view of a third embodiment of the invention mounted on the threaded end of a gun barrel.

DESCRIPTION OF THE PREFERRED EMBODIMENTS

Figure 13:
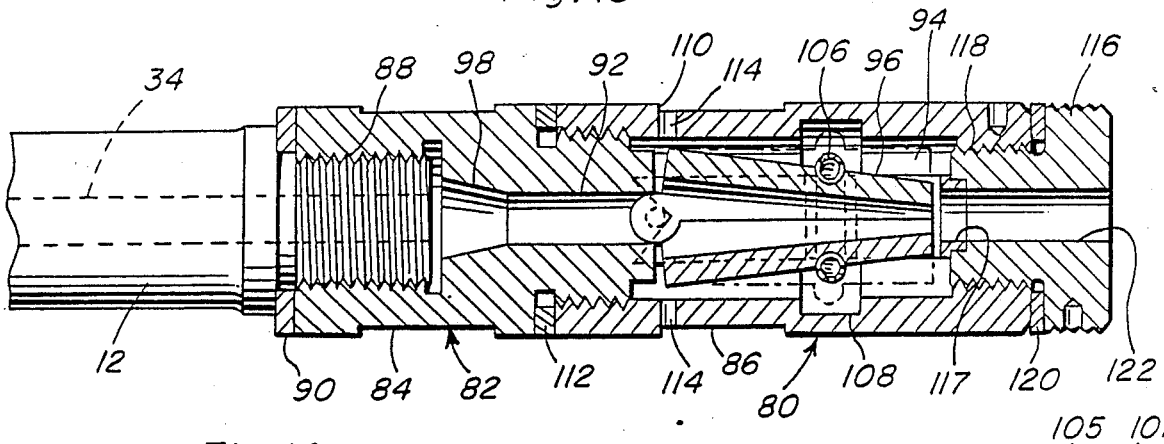
FIG. 13 is a longitudinal sectional view taken along the line 13—13 on FIG. 12.
Figure 14:
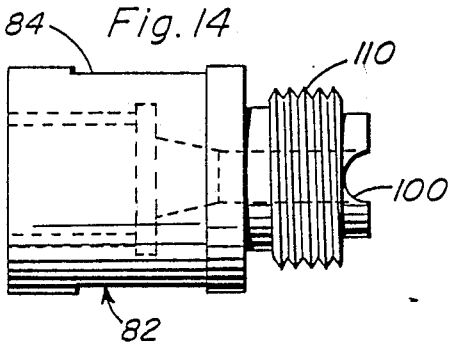
FIG. 14 is a detailed view of the adapter utilized on the embodiment illustrated in FIG. 12.

With reference to FIGS. 1–5, a gun silencer and muzzle protector and an associated adapter of the present invention is generally designated by the reference numeral 10. The gun silencer 10 is secured to a gun barrel 12 by an adapter 14 which supports a noise suppressor or silencer 16. The adapter 14 is cylindrical and includes a plurality of longitudinally extending slits 18 which permit a circumferential counteraction to clamp the adapter to the gun barrel 12. The adapter 14 includes a threaded portion 20 over which a knurled adapter mounting nut 22 is threaded frictionally to grip the exterior surface of the gun barrel 12. A lock washer or ring 23 is used to prevent the mounting nut 22 from working loose, which could result in a misalignment of the silencer 10 on the gun barrel 12.

As illustrated in FIG. 2, the adapter 14 includes a threaded portion 26 to which housing 24 is threaded to permit assembly and disassembly of the cylindrical housing 24 on the adapter 14.

The outer end of the housing 24 is provided with a threaded section 28 to which is threaded an insert 30 which has a knurled outer surface 31 to facilitate manual gripping and rotation of the insert 30. The insert 30 includes a through aperture 32 which is alignable with the bore 3 in the rifle barrel 12 thereby enabling a bullet to pass therethrough. The interior of the insert 30 is conical at 36 to partially receive expandable conical release doors 38. The interior 36 of the insert 30 is lined with a sound absorbing and heat resistant material, such as steel mesh asbestos lining 40 (similar to high-grade brake lining) or other non-asbestos material and is spaced from the expandable release doors 38 to enable them to open in a manner which will be subsequently described.

The release doors 38 are generally triangular to conformingly fit together in the shape of a cone to effectively substantially seal the axial passage between the bore 34 and the aperture 32. The expandable doors 38 are pivotally mounted to the adapter 14 by a pivotal connection 42 and are retained in their cone shape by a circumferentially extending spring 44 mounted in a groove 46. The pivotal connection 42 for the doors 38 is a spring plate or ring construction having ends thereof fixedly secured to the adapter 14 with the inner wide end of the doors 38 being spring-biasedly and rotatably retained within the pivotal connection 42.

The apex 45 of the cone formed by the intermeshing doors 38 is provided with a small opening 48 which releases some of the gas pressure generated when firing the gun and defines an exit for a bullet traversing through the bore 34. The housing 24 includes flattened portions 49 to facilitate the attachment of the silencer 16 to the adapter 14 by means of a wrench or similar tool.

FIGS. 6–11 illustrate another embodiment of the present invention which includes a modified silencer 50 directly threadably attachable to a rifle barrel 12 which includes a threaded portion 52 serving as a mounting adapter for the silencer 50 with a lock washer or ring 54 employed to securely retain the silencer 50 in operable connection with the gun barrel 12. The silencer 50 includes a cylindrically-shaped interior chamber 56 having a plurality of expandable release doors 58 pivotally retained within the chamber 56 in a manner similar to that illustrated in the embodiment of FIG. 1. A circumferentially extending spring 60 extends around the release doors 58 to retain them in a closed conically-shaped position with the release doors being provided with upwardly extending tabs or tangs 62 for retaining the spring 60 in position about the doors, as illustrated in FIGS. 7 and 8. The mounting adapter 52 includes longitudinally extending lugs 64 having apertures 66 therein with the release doors 58 provided with cooperable lugs 68 having apertures 70 extending therethrough, whereby a pivotal interconnection therebetween can be achieved through the use of hinge pins 72. The cylindrically-shaped interior chamber 56 includes an increased diameter portion 74 to provide sufficient operating space for the spring 60, as well as sufficient space for the release doors 58 to open when firing the gun. Further, an aperture 76 is provided in the silencer 50 which is axially aligned with the bore 34 of the barrel 12 to provide for passage of a bullet fired from the gun. The aperture 76 is provided with a conically shaped portion 78 which serves to reflect some of the gas pressure and noise associated with firing the gun backwardly into the silencer 50 as well as to provide clearance for the release doors 58 in the event that they extend partially into the aperture 76.

FIGS. 12–15 illustrate a further embodiment of the present invention in which a silencer 80 is mounted on the barrel 12 of a gun by an adapter 82. Both the adapter 82 and the silencer 80 are provided with respective flattened portions 84, 86 for facilitating the use of wrenches and the like in attaching the silencer and adapter to a gun. The adapter 82 is threaded to a gun barrel 12 which has a threaded portion 88 with a lock washer 90 retaining the adapter in fixed engagement with the gun barrel 12. The adapter 82 has a longitudinally extending aperture 92 alignable with the bore 34 of the rifle barrel 12 with the aperture 92 extending into a chamber 94 in the silencer 80. A plurality of expandable release doors 96 are positioned in chamber 94. The aperture 92 has a conical section 98 which serves to reflect noise and gas pressure, as well as to guide an exiting bullet into the aperture 92 while a circumferential portion of the aperture 92 includes axial indentations 100 proximate to a periphery thereof which serves as bearing surfaces for circular tangs 102 integral with the expandable release doors 96. Only two expandable release doors 96 are shown in this embodiment of the invention with the release doors including spring retaining grooves 104 and being pivotal by rotation of the tangs 102 within the circular indentations or bearing surfaces 100. A circumferentially extending spring 106 is employed to retain the doors 96 in a closed, cone-shaped position with the spring being positioned and retained within the aligned grooves 104. The cylindrical chamber 94 has an increased diameter portion 108 to provide sufficient space for the retention and movement of the spring 106 and the associated doors 96 within the chamber.

The adapter 82 is provided with a threaded portion 110 for attachment of the silencer 80 thereto, whereby the silencer may be exchanged or removed without necessitating a concurrent removal of the adapter 82 from the gun barrel 12. A circumferentially extending lock washer 112 provides a secure connection between the adapter 82 and the silencer 80. Vent holes 114 are provided in the silencer 80 to control the gas pressure therein and a removable insert 116 is provided on the silencer 80 to facilitate its assembly and disassembly and permit selection of caliber size when the silencer is to be used on a different caliber gun. The insert 116 includes a threaded section 118 for a threaded attachment to the silencer 80 with a lock washer providing a secure connection between the insert and the silencer. The insert 116 has a longitudinal aperture 122 through which an exiting bullet may pass in the manner as aforedescribed.

Figure 15:
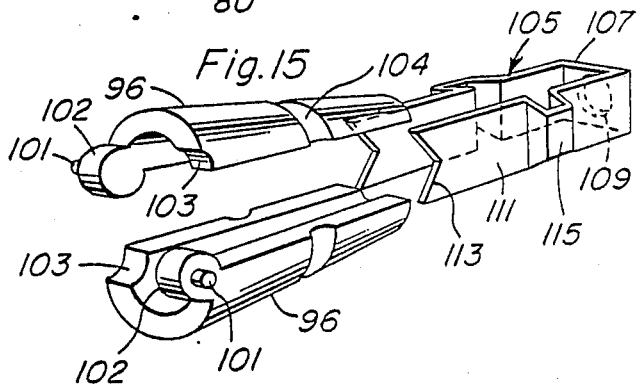
FIG. 15 is an exploded perspective view of a modified embodiment of release doors utilized on the embodiment of FIG. 12.

With particular reference to FIG. 15, each of the two expandable release doors 96 are provided with a cup-shaped indentation 103 located to slidably engage a circular tang 102 associated with the opposed expandable door 96 when the doors are in their assembled cone-shaped position. Each circular tang 102, in addition to being rotatively, bearingly positioned within the semi-circular indentations 100, is also rotatively positioned within a cup-shaped indentation 103 associated with the opposed expandable door 96 with the two doors 96 mating to form the conical construction illustrated in FIG. 13.

In order to prevent the doors 96 from slamming forwardly and reduce friction at the exit end thereof, each of the tangs 102 is provided with an outwardly extending pin 101 in perpendicular relation thereto. A generally U-shaped member 105 is positioned in chamber 94 and includes a web portion 107 having an aperture 109 adjacent to and aligned with the passageway defined by the doors 96 and a pair of legs III extending alongside the longitudinal juncture between the doors 96. Each leg 111 includes a notch 113 in the free end thereof and an offset portion 115 is received in recess 108. As illustrated, web portion 107 abuts against the inner surface of insert 116 and aperture 109 includes a cylindrical extension 117 received in a recess at the inner end of bore 122 (see FIG. 13) in order to retain the member 105 in position so that forward forces exerted on the doors 96 will be transmitted to the insert 116 through the pins 101, notches 113, legs 111 and web portion 107.

Figure 16:
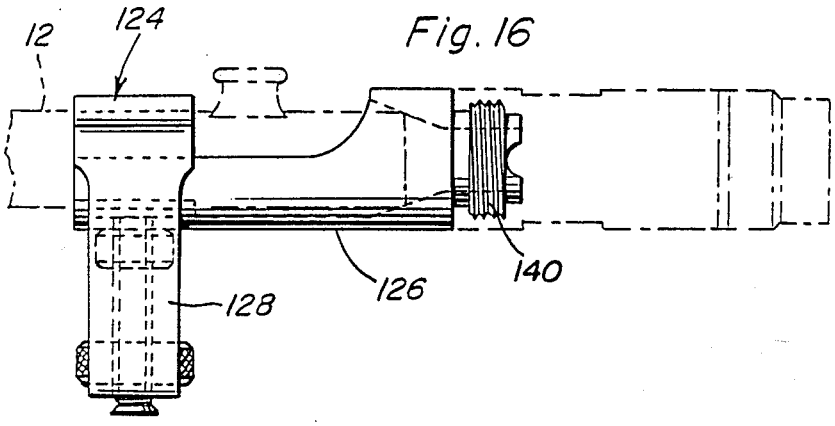
FIG. 16 is a side elevational view of a further embodiment of the invention utilizing a modified adapter.
Figure 17:
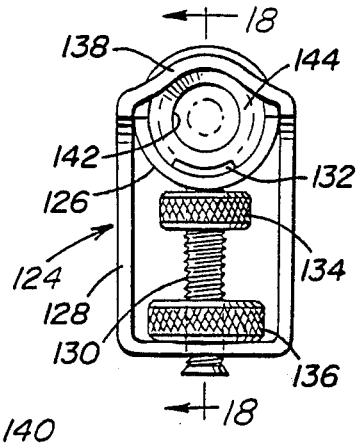
FIG. 17 is an end elevational view of the modified adapter illustrated in FIG. 16.
Figure 18:
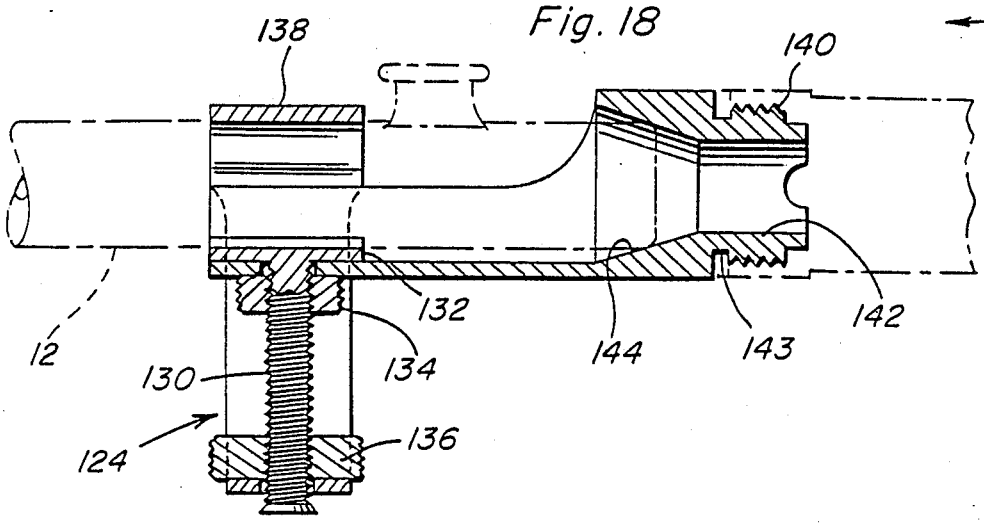
FIG. 18 is longitudinal sectional view of the modified adapter taken along the line 18—18 on FIG. 17.

FIGS. 16–18 illustrate a universal adapter 124 employed to mount the various embodiments of the silencer portion of the present invention to an existing gun barrel 12 without the necessity of modifying the gun barrel by providing an integral threaded portion or the like. The adapter 124 includes a cylindrical member 126 mounted on a gun barrel 12 and a radially extending clamp member 128 in operable engagement therewith. The clamp member 128 includes a threaded rod portion 130 positioned therein which has an arcuately-shaped barrel engaging member 132 on the inner end thereof and a locking nut 134 and an actuating nut 136 to move the threaded rod 130 longitudinally to clamp the barrel engaging member 132 snugly into engagement with the rifle barrel 12. In effect, an upward movement of the threaded rod 130 results in the forcing of the gun barrel 12 into engagement with a topmost portion 138 of the support member 128 to securely clamp the universal adapter 124 to the barrel 12. The universal adapter 124 is provided with a threaded end portion 140 for attachment of a silencer thereto, with an axially extending aperture 142 serving to establish communication between the bore 34 of the gun barrel 12 and an interior chamber associated with the silencer. Further, a conical portion 144 in the aperture 142 engages the gun barrel 12 as illustrated in FIG. 18. A lock washer may be positioned in the groove 143 to provide secure attachment of a silencer to the adapter 124.

Figure 19:
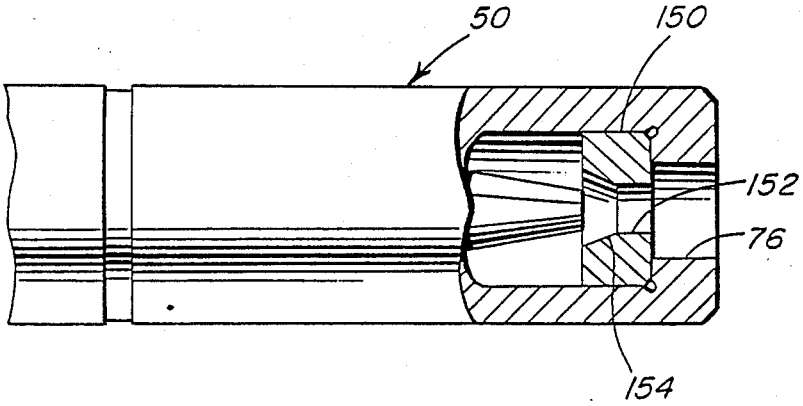
FIG. 19 is detailed view, partly in section, illustrating a caliber change insert for use with the present invention.
Figure 20:
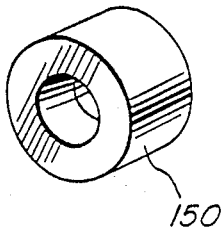
FIG. 20 is a perspective view of the caliber change insert.

FIGS. 19 and 20 illustrate the use of a caliber change insert 150 in the construction of the present invention. FIG. 19 illustrates a silencer 50, as shown in FIG. 6, having an exit aperture 76 of a specific diameter or caliber to accommodate a bullet of similar size or caliber. In the event that the silencer 50 is to be utilized in connection with a gun having a smaller diameter bullet, the caliber change insert 150 may be selectively positioned within the silencer 50 to serve as the means of utilizing the silencer in combination with the smaller caliber gun. Specifically, the caliber change insert 150 is provided with a smaller diameter aperture or bore 152 having a conical section 154 for guiding an exiting bullet therethrough.

Figure 21:
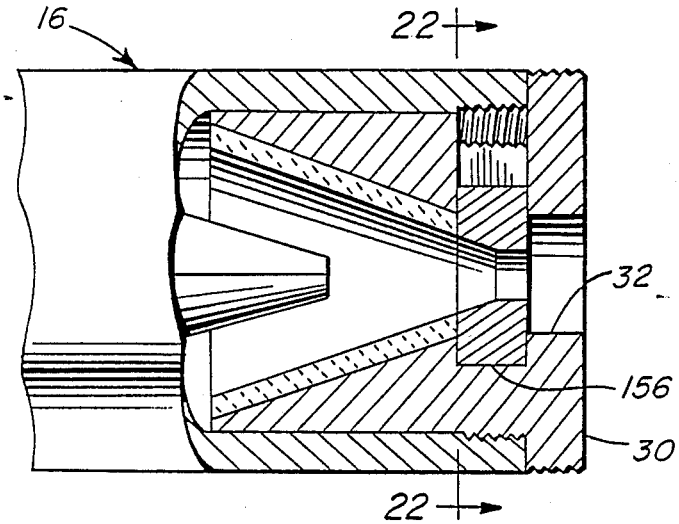
FIG. 21 is a detailed view, partly in section, illustrating a caliber change insert positioned within the gun silencer illustrated in FIG. 1.
Figure 22:
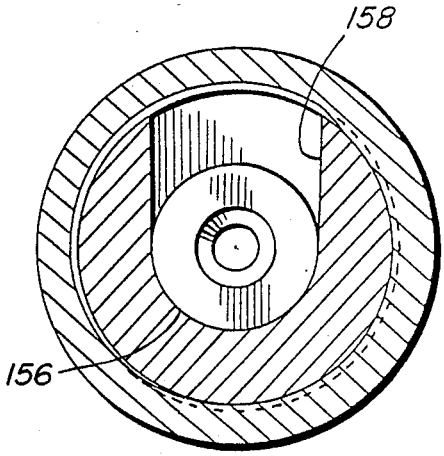
FIG. 22 is a transverse sectional view taken along the line 22—22 on FIG. 21.
Figure 23:
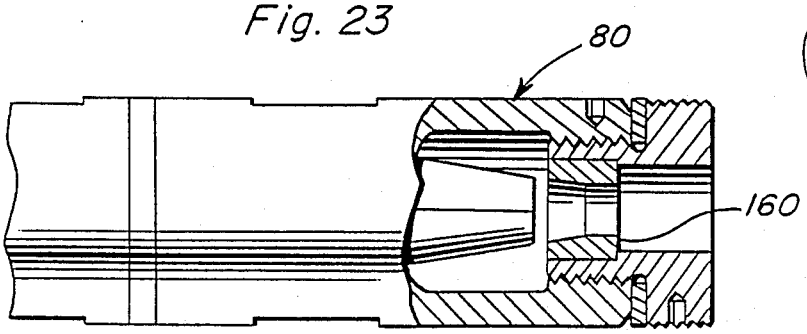
FIG. 23 is a detailed view, partly in section, illustrating a caliber change insert within the gun silencer illustrated in FIG. 12.
Figure 24:
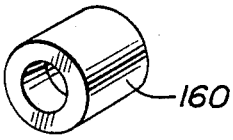
FIG. 24 is a perspective view of the caliber change insert used in FIG. 23.

FIGS. 21 and 22 illustrate the use of a caliber change insert 156 in combination with the silencer 16 as illustrated in FIG. 1 of the drawings, such caliber change insert 156 being selectively positionable proximate the exit aperture 32 through the use of a guide slot 158 positioned therein and then being fixedly secured in position by tightening insert 30. FIGS. 23 and 24 illustrate the use of a caliber change insert 160 in combination with the silencer 80 illustrated in FIG. 12 of the drawings.

In use, each of the disclosed silencers normally have the expandable release doors in a closed, conically-shaped position, such closed position being facilitated through the use of the aforedescribed circumferentially extending springs. Upon firing the gun to which the particular silencer is attached, the exiting bullet, along with the attendant gas pressure, will operate to force the expandable release doors apart against the retaining force of the circumferentially extending spring. The doors permit the bullet to pass through the silencer and outwardly through the exit aperture, while the release doors serve to dampen the noise associated with the discharge of the gun by reducing the rate of air return back into the gun barrel after the bullet has left, as well as by creating a substantial back pressure of the gas discharge associated therewith. In the event that the silencers are to be used on guns of different calibers, the aforedescribed caliber change inserts may be utilized to effectively permit the use of a particular silencer on guns of smaller caliber. Each of the disclosed silencer constructions may be selectively interchanged with each disclosed adapter construction.

When the housing component of the gun silencer is removed, the adapter and pivotal, cone-shaped doors will function as a muzzle protector. If a gun muzzle with the exposed doors attached is accidentally engaged with the ground, any plugging caused by mud, snow or other debris will collect or become lodged in the cone-shaped doors rather than in the gun barrel itself. The gun can still be fired even with the plug in the cone-shaped doors since they merely expand and let the plugging material blow out without damage to the gun barrel muzzle. Without the muzzle protector, if the muzzle of the gun barrel becomes plugged and the gun fired, the gun barrel may be destroyed and the person firing a plugged gun could be injured.

Figure 25:
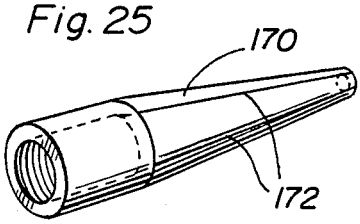
FIG. 25 illustrates a one-piece gun silencer and muzzle protector.

FIG. 25 discloses a one-piece, conical silencer and muzzle protector which includes a tapered body 170 threadedly attached to a gun barrel with the body 170 including a plurality of longitudinal slits 172 which enable the areas between the slits to expand to serve as a silencer and muzzle protector. This embodiment of the invention functions in the same manner as the other embodiments without using a separate housing.

The embodiment of FIG. 13 will be altered when used as a muzzle protector to retain the door assembly in assembled relation. The pins 101 will be mounted on the adapter 82 adjacent to the recesses 100 and the ends of the legs 111 will be provided with apertures rather than notches 113 with apertures snapping over the pins 101 to retain the doors mounted on the adapter 82 when the housing is removed for use of the device as a muzzle protector.

While the versatility and usefulness of the present invention has been clearly described, various minor details have not been disclosed. For example, it is expected that the adapters and silencers employed in the present invention would be constructed of a high grade steel or stainless steel material, while any number of expandable doors could be utilized in a particular silencer. Further, the disclosed caliber inserts might be constructed with exit apertures that are 3 to 5 thousands of an inch larger than a particular bullet so as to assure an unencumbered exit of the bullet from the silencer. Regardless of the exit aperture diameter, it has been found that the particular construction of the silencer forming the present invention will reduce the noise associated with a gun firing generally by a factor of 80%.

Additionally, the present invention permits effective usage for other purposes. For example, from a marketing standpoint, the expandable doors in conjunction with a circumferentially extending spring could be operated by some conventional means in a manner whereby they function as a mixer or a blender. Specifically, by such an arrangement, an appropriate mixing or blending of paint, fiberglass, water and chlorine, seed and fertilizer, epoxy mixer, or various other chemicals could be achieved. Further, the expandable door construction of the present invention might also operate as a one-way valve. For example, such a valve might be utilized as a heart valve in the medical field or a low viscosity check valve for crude oil. Further, it could be placed in a gas tank filler tube to prevent shiphoning or it could be placed in a pipe to prevent rats or other rodents from entering a building or house. In this respect, the use of the present invention as a one-way valve is limited only by the imagination of the user.

Further still, the silencer of the present invention could be employed as a muffler, as in its preferred construction as a gun silencer and muzzle protector, wherein the same might be used to muffle the operation of a chain saw, automobile, motorcycle, air hammer, or the like. Also, the expandable door construction of the invention could be utilized as a tool, specifically for the purpose of holding wire so the same might be twisted together, or as a pipe threader or cutter. Also, in its role as a tool, the invention might be employed as a pipe vise, a rope or cable brake, a wood splitter, or some other type of holder or fastener, just to name a few of its potential uses. Finally, the present invention could be employed in the capacity of a lock, such as on handcuffs, or as a seal where appropriate.

With respect to the above description, it should be realized that the optimum dimensional relationships for the parts of the invention are deemed apparent and obvious to one skilled in the art to which the invention pertains, and all equivalent relationships to those illustrated in the drawings and described in the specification, to include modification of form, size, arrangement of parts and details of operation, are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resorted to, falling within the scope of the invention.

What is claimed as new is as follows:

1. A gun silencer and muzzle protector comprising housing means having a passage therethrough, means attaching said housing means to a gun barrel with said passage being substantially longitudinally aligned with a bore of said gun barrel, and expansion means positioned within said housing means and serving to normally substantially close said passage through said housing means, said expansion means being expandable to permit a bullet exiting from said gun barrel to pass through said passage and then being rapidly closeable to substantially reduce the rate of air return to said bore of said gun barrel subsequent to passage of said bullet to substantially reduce noise generated when firing the gun, said attaching means including an adapter selectively connecting the housing means with said gun barrel, said adapter including legs providing pivotal attachment of said expansion means thereto.

2. A gun silencer and muzzle protector comprising housing means having a passage therethrough, means attaching said housing means to a gun barrel with said passage being substantially longitudinally aligned with a bore of said gun barrel, and expansion means positioned within said housing means and serving to normally substantially close said passage through said housing means, said expansion means being expandable to permit a bullet exiting from said gun barrel to pass through said passage and then being rapidly closeable to substantially reduce the rate of air return to said bore of said gun barrel subsequent to passage of said bullet to substantially reduce noise generated when firing the gun, said expansion means including a plurality of pivotally mounted doors arranged in a normally cone-shaped closed abutting relationship, said doors having rounded lugs on bottommost portions thereof, said rounded lugs being engageable with indentations on the adapter.

3. The gun silencer as defined in claim 2 wherein said doors are provided with cup-shaped indentations receiving said rounded lugs.

4. The structure as defined in claim 3 wherein each of said doors includes a laterally extending pin, a U-shaped member straddling said doors and including a web and legs extending alongside the doors, said legs including a notch in the free end thereof engaging a pin, said web including an aperture aligned with the passage though the housing means, said web abuttingly engaging the housing means to prevent said doors from slamming forwardly when a bullet passes through said doors.

* * * * *